US005152529A

United States Patent [19]

Okada

[11] Patent Number: 5,152,529

[45] Date of Patent: Oct. 6, 1992

[54] GAME MACHINE

[75] Inventor: Kazuo Okada, Tokyo, Japan

[73] Assignee: Kabushiki Kaisha Universal, Tochigi, Japan

[21] Appl. No.: 560,583

[22] Filed: Jul. 30, 1990

[30] Foreign Application Priority Data

Jul. 28, 1989 [JP] Japan ..... 1-195747

[51] Int. Cl.[5] ..... A63F 5/04

[52] U.S. Cl. ..... 273/143 R; 273/138 A

[58] Field of Search ..... 273/143 R, 143 A, 143 B, 273/143 C, 143 D, 143 E, 138 R, 138 A, 142 R, 142 HA, DIG. 28, 142 H; 364/410-412

[56] References Cited

U.S. PATENT DOCUMENTS 3,810,628 5/1974 Vigan ..... 273/143 R X
4,700,948 10/1987 Okada ..... 273/143 R

FOREIGN PATENT DOCUMENTS 0082706 6/1983 European Pat. Off. ..... 273/143 R
2756361 6/1979 Fed. Rep. of Germany .
2156565 10/1985 United Kingdom .
2157047 10/1985 United Kingdom ..... 273/143 R
2160345 12/1985 United Kingdom .
2165074 4/1986 United Kingdom ..... 273/143 R
2170636 8/1986 United Kingdom ..... 273/143 R
2182476 5/1987 United Kingdom ..... 273/143 R
2226907 7/1990 United Kingdom ..... 273/143 R
WO86/05407 9/1986 World Int. Prop. O. .

*Primary Examiner*—William H. Grieb
*Assistant Examiner*—Sebastiano Passaniti
*Attorney, Agent, or Firm*—Young & Thompson

[57] ABSTRACT

A game machine displays in a display window a first and a second series of symbols in a column such that the first series of symbols are movingly displayed and thereafter a predetermined number of stationary symbols of the first series are displayed in a display window when the first series stops. If at that time a specific symbol of the first series, e.g. an opening or a transparent area, stops in the display window, the second series of symbols displayed in the position of the specific symbol are moved, and then a symbol of the second series is stopped in that position, whereby an additional game can be played in connection with the second symbol series.

15 Claims, 8 Drawing Sheets

GAME MACHINE

BACKGROUND OF THE INVENTION

The present invention relates to game machines, and more particularly to game machines displaying a plurality of series of symbols.

Slot machines are well known as game machines in which players can play a game by inserting coins or tokens (hereinafter referred to as coins) prior to starting the game. A slot machine is provided with, for example, three reels, each of which has a plurality of symbols arranged on its outer periphery in a predetermined sequence. Whether a prize should be awarded, and if so what prize, is determined depending on the combination of symbols displayed within respective display windows when the reels stop after rotating. If the resulting symbol combination coincides with one of a plurality of predetermined winning symbol combinations, the game is judged as a hit game, and a predetermined number of coins, according to the rank of the win, is paid out.

Among these slot machines are also those in which the player can advance the reel again after all the reels have stopped if, for example, any reel displays a specific symbol at the end of the reel rotation. This provides the slot machines with an additional function for enabling an additional game, and this helps to hold the player's interest.

But in this additional game, since the player is allowed merely to rotate some of the same reels as in the first or regular game, the variety of symbol combinations obtainable in the additional game is the same as in the regular games. Therefore, this known additional game function does not greatly relieve the monotony of playing the slot machine.

OBJECTS OF THE INVENTION

It is, therefore, an object of the present invention to overcome this drawback, namely the monotony of playing such game machines in which a hit is determined depending on the displayed symbol combination.

It is also an object of the present invention to provide a game machine which can multiply the symbols or can display the symbols in a special manner so as to provide greater amusement for the player.

SUMMARY OF THE INVENTION

The above and other objects are achieved by providing a first and a second series of symbols, each series comprising a plurality of movable symbols; first display control means for displaying the first series of movable symbols and thereafter a predetermined number of stationary symbols of the first series in a display window; second display control means for displaying the second series of movable symbols in a position within the display window in which a specific symbol of the first series is displayed when the specific symbol stops within the display window, and thereafter displaying a stationary symbol of the second series in that position.

The invention can be adapted to a game machine in which at least one reel having symbols on its outer periphery is provided, the reel being formed as a double reel comprising inner and an outer reel, wherein the outer reel has a transparent portion which is about as large as or larger than a symbol, and through which at least one of the symbols on the inner reel can be viewed.

The present invention is also applicable to video-type slot machines where symbols are displayed on a CRT screen of a graphic display unit.

In the game machine according to the present invention, it is possible to play an additional game if a specific symbol is displayed in the display window when a first series of symbols comes to rest, and in the additional game, the moving symbols of the second series are displayed and thereafter one of the second series of symbols is stopped in the position wherein that specific symbol is displayed. As the first series of symbols is fixed during the additional game, and both symbols adjacent to the specific symbol are unchanged, such a symbol display is not only visually novel, but also makes it possible to display two series of symbols in a column, so that the number of symbol combination patterns will be easily increased and also the entertainment value of the game will be improved without enlarging the displaying space.

BRIEF DESCRIPTION OF THE DRAWINGS

Other objects and advantages of the invention will become apparent from the following description taken in conjunction with preferred embodiments with reference to the accompanying drawings, in which.

DETAILED DESCRIPTION OF THE INVENTION

Figure 1:
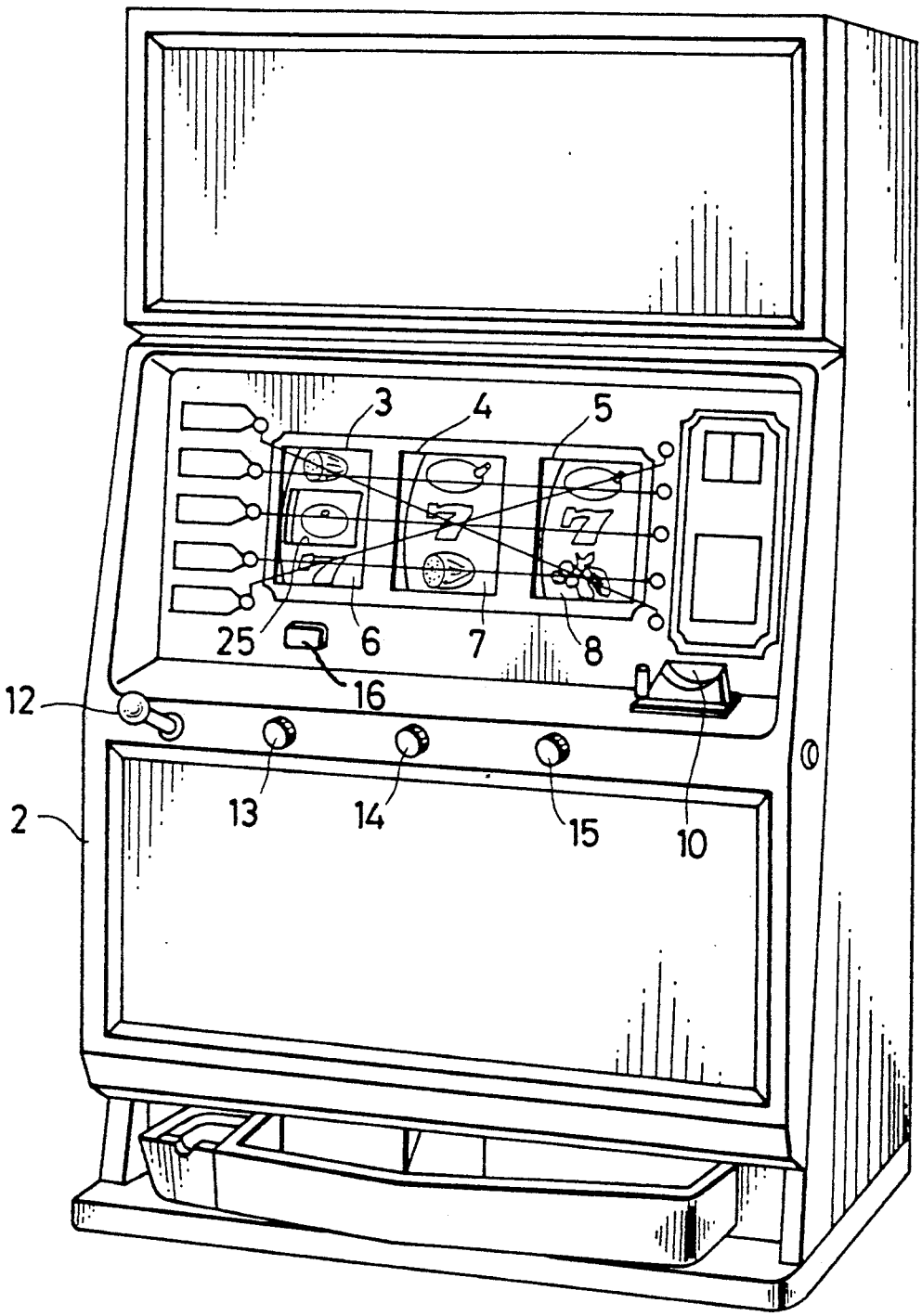
FIG. 1 is a perspective view of the front of a slot machine embodying the present invention.
Figure 2:
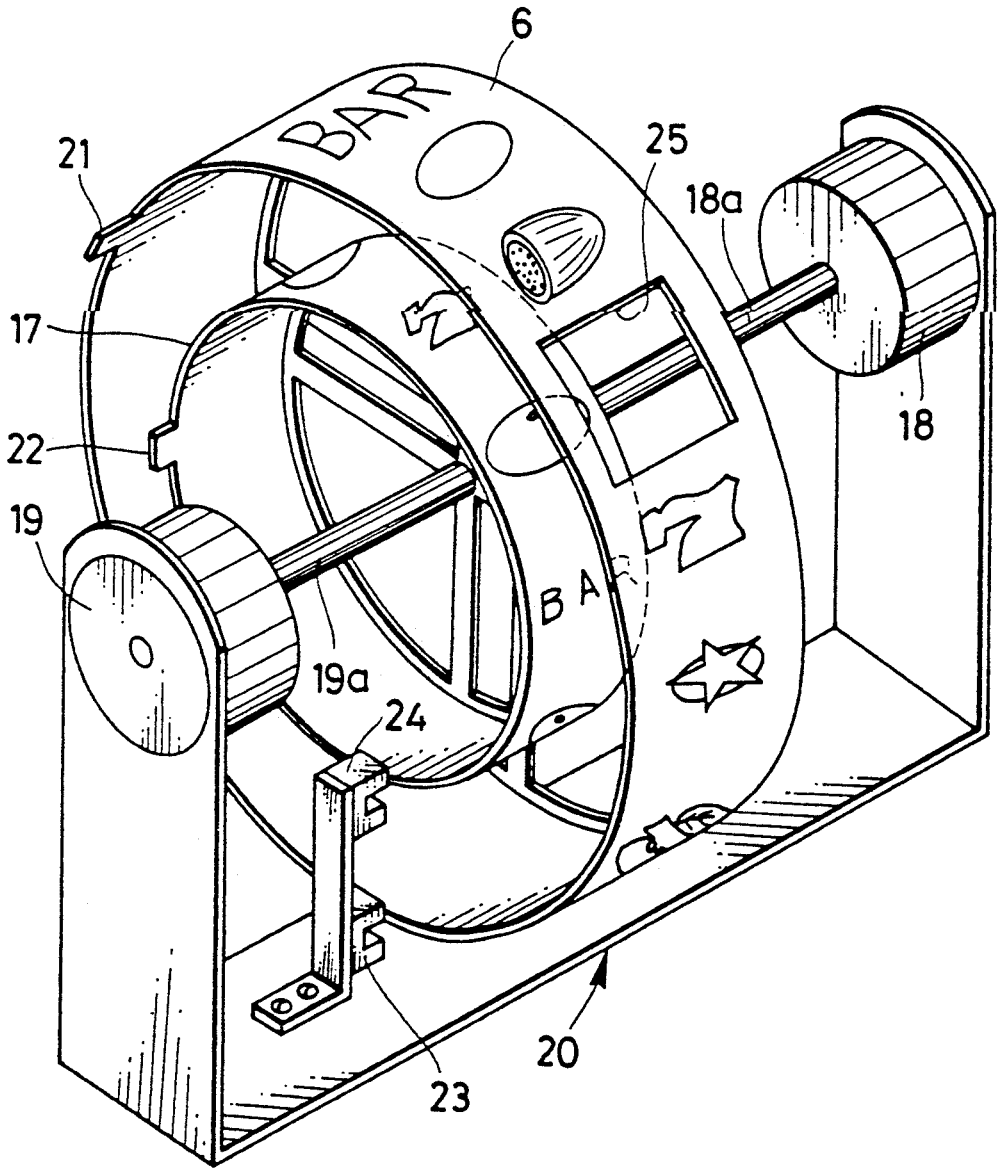
FIG. 2 is a perspective view of a double-reel assembly according to an embodiment of the invention.

Referring to FIG. 1 showing the outer appearance of the front of a slot machine embodying the present invention, the slot machine 1 is provided in its front panel 2 with three display windows 3 to 5, inside which the first, second and third reels 6 to 8 are disposed. Each reel has a series of symbols disposed on its outer periphery at regular intervals and is rotatable to display moving symbols within the corresponding display window 3, 4 or 5. When the reels 3 to 5 stop, three symbols can be observed at once through each window.

There are five winning lines across the windows 3 to 5, namely, three horizontal lines and two diagonal lines. Which of the winning lines are effective is dependent on the number of coins inserted prior to the start of a game. For example, when a single coin is inserted, only the middle horizontal line becomes effective, and when two coins are inserted, the three horizontal lines become effective in judging a win. When three coins are inserted, all the five lines including the two diagonal lines become effective. For simplicity, however, the following description will be given for the case in which the middle horizontal line alone is effective.

Upon actuating a start lever 12 after the insertion of a coin through a coin slot 10, the first to third reels 6 to 8 simultaneously start rotating. The rotation of each reel is caused to stop in response to the depression of a stop button 13, 14 or 15 which is provided for each reel. Whether a game results in a hit game, that is, the winning of a prize, or a lost game is determined depending on which combination of symbols stops on the winning line. If the combination of symbols on the winning line corresponds to one of the predetermined hit combinations, a predetermined number of coins are paid out according to the rank of the obtained hit combination. Designated by 16 is an additional game start button, which can be actuated to start an additional game only when the result of the first game, that is, a regular game, enables the player to play such an additional game. Such an additional game will be described later in detail.

Figure 3:
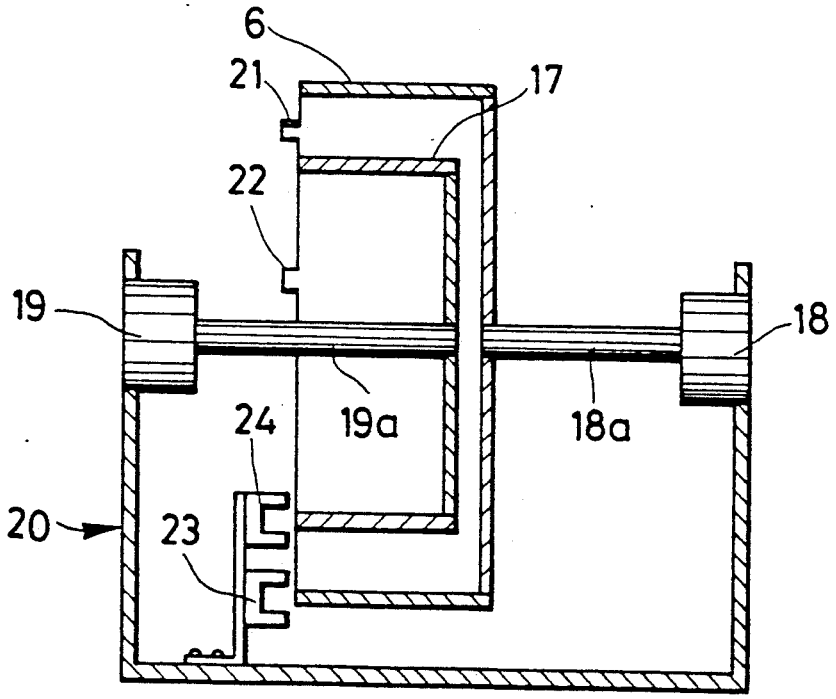
FIG. 3 is a sectional view of the double-reel assembly of FIG. 2.

Referring now to FIGS. 1 and 3 showing the details of the first reel 6, the first reel 6 is an outer reel of a double reel assembly 20, wherein an inner reel 17 is disposed coaxially inside the outer reel 6. The reel 6 is directly connected to a drive shaft 18*a* of a stepping motor 18, while the inner reel 17 is directly connected to a drive shaft 19*a* of a stepping motor 19. The reels are driven to rotate by the respective stepping motors 18 and 19, independently from each other. Each of the reels 6 and 17 is formed at its one edge with a light-shielding lug 21, 22, which is detected by a photo-interrupter 23, 24 disposed in association with each of the reels 6 and 17. The photo-interrupter 23, 24 outputs a pulse each time the light-shielding lug 21, 22 passes therethrough, that is, every one revolution of the associated reel.

On the outer periphery of the first reel 6, there are plural different symbols such as "PLUM", "ORANGE" and the like and also a specific symbol formed as a square opening or gap 25 whose size is substantially equal to those of the other symbols. Also the inner reel 17 has plural different symbols such as "7", "PLUM", "BAR" and the like which are disposed at regular intervals on the outer periphery of the reel 17. The symbols on the inner reel 17 may, of course, be different in sequence and identity from the symbols on the first reel, and the inner reel has no such specific symbol as the square opening 25. Needless to say, the opening 25 may have another shape or may be covered with a transparent material.

As is obvious from FIG. 1, one of the symbols on the inner reel 17 can be observed through the opening 25 of the first reel 6 when the opening 25 stops within the display window 3. There may be more than one opening 25, or an opening may extend over at least two symbols on the inner reel 17. In case the first reel is made of a transparent plastic material whose peripheral surface is encircled by an opaque tape having printed symbols thereon, it is possible to form a transparent area in the tape so as to comprise the opening 25; and it is to be understood that the term "transparent portion" as used hereinafter includes both such a transparent area and an open window.

Figure 4:
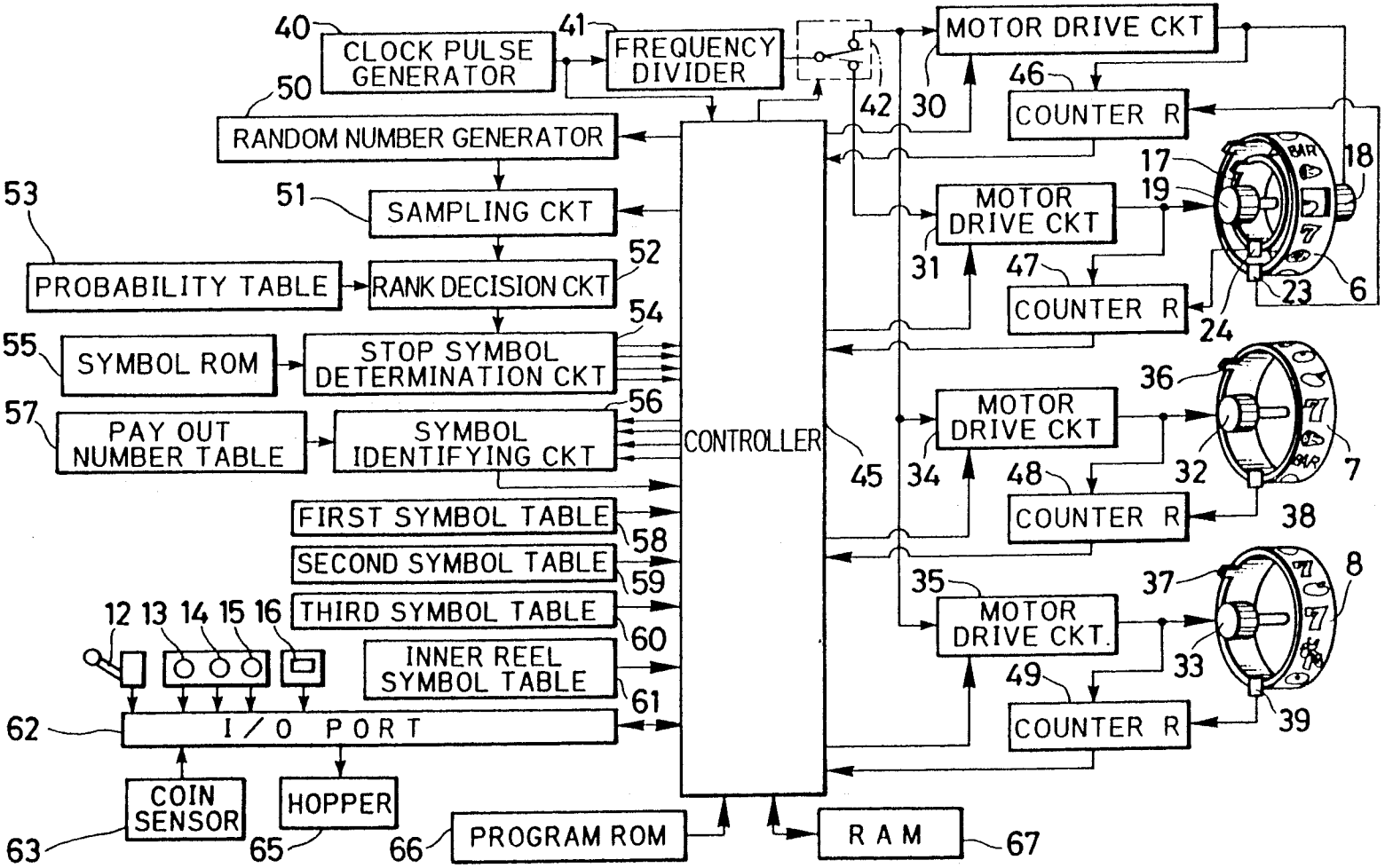
FIG. 4 is a block diagram showing an example of a controlling circuit for the slot machine.

FIG. 4 shows an example of a control circuit for the above-described slot machine, in which motor drive circuits 30 and 31 control the starting and stopping of the rotation of the stepping motors 18 and 19 so as to drive the first and the inner reels 6 and 17, respectively, in an appropriate manner. The rotation of stepping motors 32 and 33 is controlled by motor drive circuits 34 and 35 for driving the second and the third reels 7 and 8, respectively. The second and the third reels 7 and 8 are also formed with light-shielding lugs 36 and 37 which are detected by photo-interrupters 38 and 39, respectively, in the same way as the photo-interrupters 23 and 24.

The motor drive circuits 30, 31, 34 and 35 are actuated upon receipt of a pulse signal generated by a clock pulse generator 40 and which is divided in a frequency-divider 41. The pulse signal is supplied to the motor drive circuits 30, 34 and 35 when a change-over switch 42 is in a first switching position as shown by a solid line in FIG. 4, while the pulse signal is supplied to the motor drive circuit 31 when the change-over switch 42 is in a second position shown by a dashed line. The motor drive circuits 30, 31, 34 and 35 control the starting and stopping of the corresponding stepping motors 18, 19, 32 and 33 according to commands from a controller 45. That is, the motor drive circuits 30, 31, 34 and 35 supply each an individually predetermined number of drive pulses to the stepping motors 18, 19, 32 and 33 in accordance with the timing of the pulse signal supplied through the change-over switch 42, wherein the number of supplied drive pulses depends on the command signal, and so the stepping motors 18, 19, 32 and 33 are driven to rotate by an amount corresponding to the number of supplied rive pulses.

Simultaneously, the driven pulses supplied to the stepping motors 18, 19, 32 and 33 are simultaneously counted by counters 46, 47, 48 and 49, respectively. Each of these counters 46 to 49 is reset to its initial value every time the associated photo-interrupter 23, 24, 38 or 39 detects the corresponding light-shielding lug 21, 22, 36 or 37. The count vales of the counters 46 to 49 are fed back to the controller 45. As described above, since the count values of the counter 46, 47, 48, 49 correspond to the number of drive pulses supplied to the stepping motors 18, 29, 32, 33, it is possible to monitor the rotational position of each stepping motor, that is, the rotational position of each reel 6, 7, 8, 17 based on the count value of the corresponding counter 46, 48, 49, 47. Consequently, the controller 45 can control each motor drive circuit 30, 31, 34, 35 so as to stop each reel at a desired position based on the monitor count value of the associated counter.

A random number generator 50 outputs a random number within a predetermined range, for example, a range from "0" to "9999", and sends it to a sampling circuit 51. The sampling circuit 51 samples the random number upon receipt of a sampling command from the controller 45. The same random number cannot be again sampled until all the other random numbers have been once sampled.

A rank decision circuit 52 decides with reference to a probability table 53 to what rank of winning the sampled random number corresponds. For example, the probability table 53 is constructed as a table memory in which all the random numbers "0" to "9999" to be generated by the random number generator 50 are classified into four ranks, namely, the range from "0" to "199" is assigned to a big hit, the range from "200" to "799" is a middle hit, the range from "800" to "1999" to a small hit, and the range from "2000" to "9999" to a lost game. Depending on the range to which the sampled random number belongs, the rank decision circuit 52 outputs a judgment signal representative of one of these winning ranks, that is, a big hit signal, a middle hit signal, a small hit signal or a lost game signal.

In response to the judgment signal from the rank decision circuit 52, a stop symbol determination circuit 54 selects a combination of symbols corresponding to the winning rank indicated by the judgment signal with reference to a symbol ROM 55 and outputs a series of symbol codes, wherein each code represents a symbol to be displayed on each reel. The symbol ROM 55 stores data about symbol code combinations representing possible symbol combinations for each winning rank, so that the kind of symbol to be stopped on the winning line in each reel is appropriately determined in accordance with the judgment signal from the rank decision circuit 52. It is to be noted that as the slot machine of the present embodiment has actually four reels inclusive of the inner reel 17, the stop symbol determination circuit 54 outputs four kinds of symbol codes, which will be describer later in detail. In case there are several kinds of symbol combinations for the same winning rank, one of those combinations is randomly selected. If the judgment signal indicates a lost game, the stop symbol determination circuit 54 selects at random one of the symbol combinations which are assigned to lost games.

When the reels 6 to 8 stop, it is determined which symbols are positioned on the winning line 9 in the respective reels 6 to 8. Since the number of drive pulses per rotation of each reel and the number and the sequence of symbols disposed on each reel are constant, it is possible to identify the symbols positioned on the winning line by the count values of the counters 46 to 49. For this purpose, there are provided first, second and third symbol tables 58 to 60 and an inner reel symbol table 61. These symbol tables 58 to 61 store symbol codes for the individual symbols of the reels 6 to 8 and 17 along with data concerning the position of each symbol as a rotational position of the stepping motor 18, 19, 32 or 33, respectively. Therefore, it can be determined which symbol is positioned on the winning line 9 for each reel based on the count value of each counter, that is, the number of drive pulses supplied to each stepping motor, with reference to each of these symbol tables 58 to 61. The symbol identifying circuit 56 then refers to a coin pay-out number table 57 so as to supply the controller 45 with data representative of the number of coins to be paid out for the rank of the symbol combination displayed on the winning line.

Individual control signals from the start lever 12, stop buttons 13 to 15, and the additional game start button 16 are inputted through an I/0 port 62. A coin sensor 63, upon detecting each insertion of a coin and the number of inserted coins, outputs a signal to the controller 45 through the I/0 port 62. A hopper 65 is activated by the controller 45 to pay out an appropriate number of coins when a game results in a hit. A program ROM 66 stores a program for executing a series of game process including the above processing in a predetermined sequence. A RAM 67 is used to write or read necessary data temporarily for executing the game processing.

Figure 5:
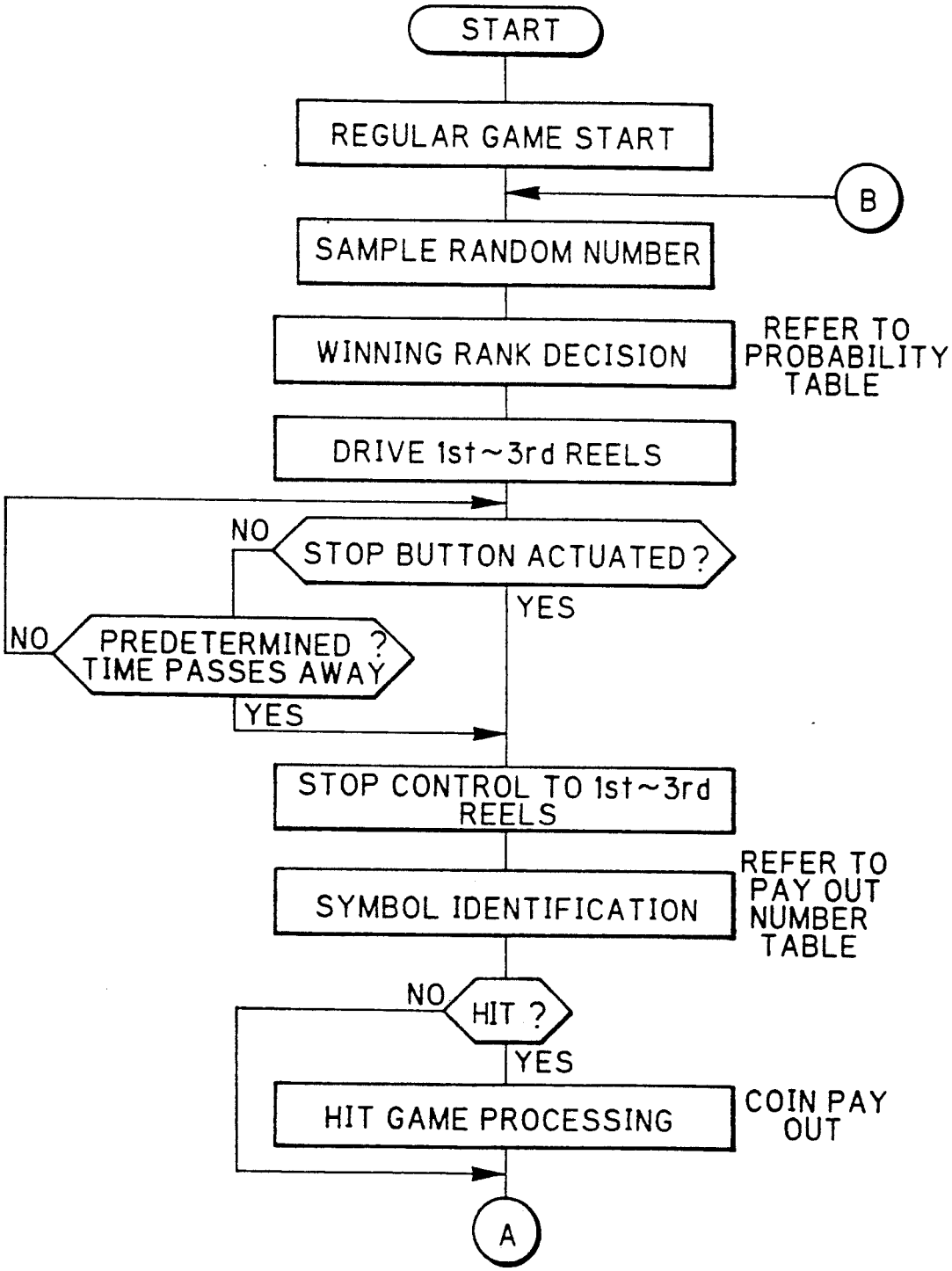
FIGS. 5 and 6 show a flow chart illustrating the processing of the slot machine.
Figure 6:
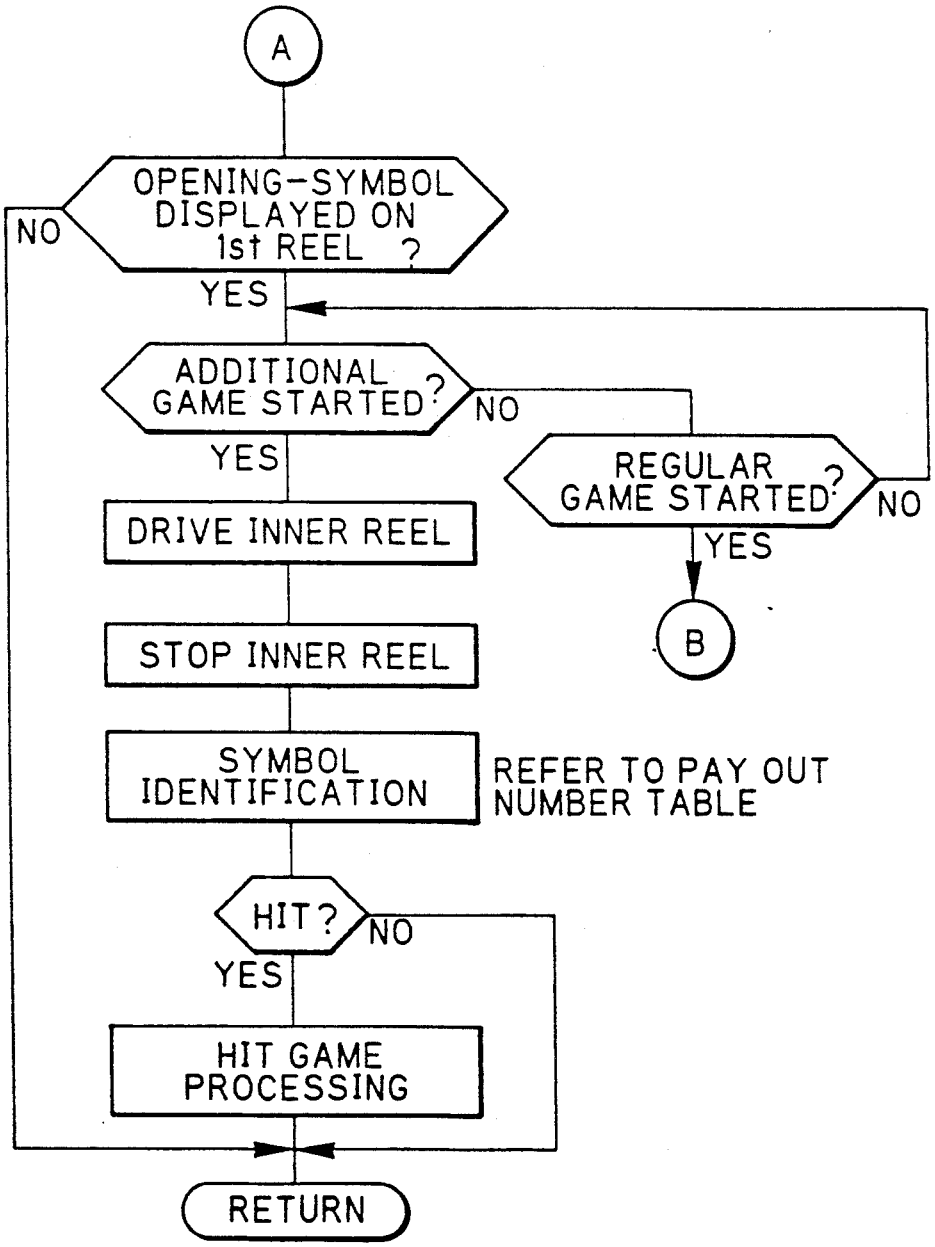

The operation of the above embodiment will now be described with reference to the flow chart shown in FIGS. 5 and 6. A regular game is started by actuating the start lever 12 after inserting, for example, a single coin. The sampling circuit 51 then samples a random number from the random number generator 50, and the rank decision circuit 52 compares this random number with the probability table 53 so as to decide the rank of winning to be given depending on the range in the table to which the random number belongs. For example when the sample random number is "150", the rank decision circuit 52 outputs a big hit signal to the stop symbol determination circuit 54, which then refers to the symbol ROM 55 so as to select one of the predetermined symbol combinations representing a big hit. Assuming that the selected combination of symbols consists of "opening", "7", "7" and "7" for the first to third and the inner reels 6, 7, 8 and 17, respectively, the stop symbol determination circuit 54 supplies the corresponding symbol codes to the controller 45.

Meanwhile, upon receipt of a start signal from the start lever 12, the controller 45 sets the change-over switch 42 in the first position shown by the solid line, so that the pulses from the clock pulse generator 40 are, after being divided by the frequency divider 41, supplied to the motor drive circuits 30, 34 and 35. When the stop symbol determination circuit 54 has determined the symbols to be stopped on the effective winning line, that is, the middle horizontal line in this case, the controller 45 outputs an actuating signal to the motor drive circuits 30, 34 and 35.

Upon receipt of the actuating signal, each motor drive circuit 30, 34, 35 starts outputting a number of drive pulses to the stepping motor 18, 32, 33 in accordance with the symbol code supplied through the controller 45, while being supplied with the divided pulse signal from the frequency divider 41. The first to third reels 6 to 8 thus start rotating at once, while the inner reel 17 does not rotate because, at that time, the stepping motor 19 is not supplied with the drive pulses. The present position of the inner reel 17 is registered in the counter 47 as the number of drive pulses counted during the preceding rotation of the inner reel 17.

After a certain time duration from the start of rotation, when the first to third reels 6 to 8 begin to rotate at a constant speed, it becomes possible to actuate the stop buttons 13 to 15. Upon depressing the stop buttons 13 to 15, the controller 45 starts controlling the motor drive circuits 30, 34 and 35 so as to stop the stepping motors 18, 32 and 33 and thus the first to third reels 6 to 8 at such positions that the combination of symbols stopped on the effective winning line corresponds to the selected symbol combination from the stop symbol determination circuit 54, while comparing the count values of the counters 46 to 48 with the data stored in the first to third symbol tables 58 to 60. It is to be noted that this stop control will be automatically started unless the player actuates the stop buttons 13 to 15 within a predetermined time duration from the moment at which all the reels 6 to 8 begin to rotate at a constant speed.

As a result of the above-described stop control, the stepping motors 18, 32 and 33 stop to stop each of the first to third reels 6 to 8 without too long a delay from the time of depressing each stop button 13 to 15. If the control has been executed in a proper manner, the symbol combination determined by the stop symbol determination circuit 54, that is, "opening"-"7"-"7" in this case, is displayed on the winning line. When the first to third reels 6 to 8 completely stop, the count values of the counters 46, 48 and 49 are compared with the data in the first to third symbol tables 58 to 61, respectively, so as to confirm whether the predetermined symbol combination is displayed. In addition, because the symbol of the first reel 6 stopping on the winning line is "opening", the present count value of the counter 47 is compared with the data in the inner reel symbol table 61 so as to identify the symbol on the inner reel 17 that can be viewed through the opening 25. When, for example, an "ORANGE" is displayed within the opening 25 as shown in FIG. 1, the symbol combination is identified as "ORANGE"-"7"-"7", and thus the regular game is judged as a lost game and no win is awarded.

The reason why the controller 45 identifies the displayed symbol combination at the time of stopping of the first to third reels 6 to 8 is that a symbol combination on the winning line might seldom differ from the determined combination if any stop button 13 to 15 should be actuated with a certain timing.

When the opening 25 is displayed on the first reel 6 on the effective winning line at the end of the above-described regular game, the player can play an additional game.

If the player decides to play this additional game, he depresses the additional game start button 16 and inserts a coin into the coin slot 10. Unless the additional game button is depressed, the insertion of a coin is considered to indicate that the next regular game is going to be stared.

Upon depressing the additional game start button 16, an additional game mode signal is supplied from the I/0 port 62 to the controller 45, which then sets the change-over switch 42 to the second position, so that the pulses from the frequency divider 41 are supplied to the motor drive circuit 31 alone. Thereafter when the coin sensor 63 detects the insertion of a coin, the controller 45 supplies an actuating signal to the motor drive circuit 31, thereby driving the stepping motor 19 to rotate the inner reel 17. The other reels 6 to 8 stay in the latest stopped positions during the additional game.

Simultaneously with the driving of the stepping motor 19, the counter 47 counts the number of drive pulses supplied to the stepping motor 19 for every one rotation thereof. After a certain time duration from the start of rotation, the controller 45 starts the stop control of the inner reel 17. But it may, of course, be possible to provide a corresponding stop button and start the stop control of the inner reel 17 upon its actuation.

The stop control of the inner reel 17 is carried out with reference to the inner reel symbol table 61 and by comparing the count value of the counter 47 therewith in the same way as for the above-described stop control of the first to third reels 6 to 8, thereby to stop the symbol to be displayed, for example "7", within the opening 25. As the result, the symbol combination "7"-"7"-"7" is displayed on the winner line 9 in the display windows 3 to 5.

At the end of the additional game, the symbol identifying circuit 56 also identifies the symbols displayed on the winning line and refers to the pay out number table 57 so as to decide the number of coins to be paid out for the symbol combination. When the symbol combination is identified as "7"-"7"-"7", the controller 45 is allowed to output a coin pay-out signal to the hopper 65, which then pays out the corresponding number of coins.

In case more than one winning line is effective, and if the opening 25 stops on one of these winning lines and, at the same time, a hit (or winning) symbol combination is displayed on another effective winning line at the end of a regular game, the player can play an additional game after being awarded the prize for the hit obtained in the regular game. Needless to say, the player cannot play an additional game when the opening 25 stops within the display window 3 but not on the effective winning line or lines.

The slot machine according to the above embodiment, which is a kind of three-reel type slot machine, functions as a four-reel type slot machine and therefore can display a wider variety of symbol combinations than a conventional three-reel type slot machine. Besides the double reel assembly 20 comprising the first reel 6 with the single opening 25 and the inner reel 17, it is possible to form at least one opening and to provide a corresponding inner reel for each of any of the other reels. Furthermore, it is possible to start rotating the inner reel 17 simultaneously with the start of rotation of the other reels 6 to 8, so as to display moving symbols of the inner reel 17 in the opening 25 when the opening stops within the display window 3 and then to stop one of these symbols in the opening 25 after an appropriate time delay from the stop of the first reel 6. It is also possible to rotate the first reel 6 as well as the inner reel 17 in the additional game, so that not only the symbols on the inner reel 17 viewed through the opening 25 but also the symbols on the first reel 6 may be taken into account as the symbol to be displayed on the winning line for the additional game.

In order to apply the present invention to a video-type slot machine, it is necessary only to set data for displaying such a specific symbol as has a similar function to the opening 25, for example a blank, within graphic data which are stored in a ROM in accordance with the sequence of displaying graphic symbols, and when the "blank" stops on any one of the effective winning line, a series of moving symbols can be displayed in the blank in accordance with other graphic data stored in another ROM, so that one of these symbols stops in the blank position at the end of the additional game.

Figure 7:
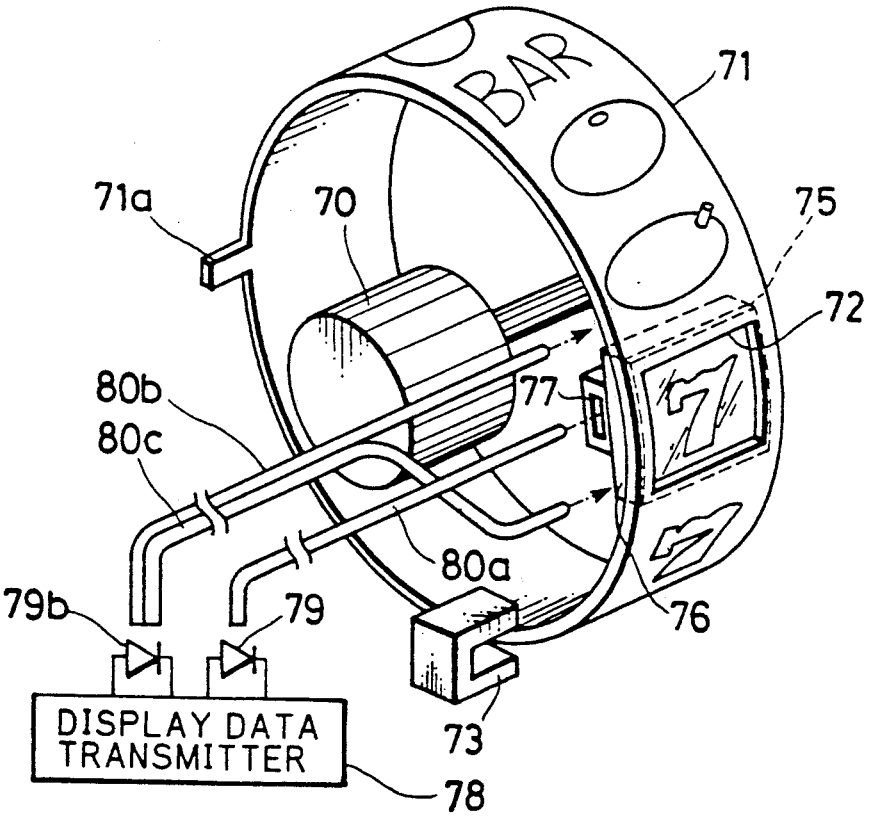
FIG. 7 shows another embodiment of the present invention.

FIG. 7 shows a reel 71 according to a further embodiment of the present invention, which can be substituted for the double reel assembly 20 shown in FIG. 1. The reel 71 which is driven by a stepping motor 70 has a series of symbols arranged at regular intervals on its outer periphery. In replacement of one of these symbols, there is provided an opening 72 that is at least about as large as the other symbols. The reel 71 is integrally formed with a light-shielding lug 71*a*, which is detected by a photo-interrupter 73 upon passing therethrough. On the inner surface of the reel 71, there is mounted a liquid crystal display panel 75, the display surface of which is exposed through the opening 72. Furthermore, a drive unit 76 including a battery and a memory storing display pattern data, and an optical signal receiver 77 are provided on the inner surface of the reel 71.

A display data transmitter 78 energizes either or both of LEDs 79*a* and 79*b* intermittently to emit light so as to generate an optical signal defined by the number and the cycle of the wink (on-off cycle) of the LEDs. The optical signal is transmitted through optical fibers 80*a*, 80*b* and 80*c*, wherein the outlets of the optical fibers 80*a*, 80*b* and 80*c* are so positioned that one of the three outlets faces the optical signal receiver 77 when the opening 72 stops on any one of three winning lines as shown in FIG. 3. If the middle horizontal winning line alone is effective, and if the opening 72 of the reel 71 stops on the middle line, only the LED 79*a* is energized to flash on and off. The optical signal receiver 77, upon receipt of the optical signal from the LED 79*a*, drives the liquid crystal display panel 75 to display a symbol corresponding to the optical signal by means of the drive unit 76. If more than one winning line is effective, then the LED 79*b* is also energized, so that the liquid crystal panel 75 stopping on any one of the effective lines displays a corresponding symbol.

In the same manner as in the first embodiment, the player can decide to play an additional game if the opening 72 stops on any one of the effective lines at the end of a regular game. When the player starts to play the additional game, the display data transmitter 78 is actuated for a predetermined time period to send to the optical signal receiver 77 an optical signal which differs from the optical signal sent to the regular game. As a result, a variety of symbols are sequentially displayed on the liquid crystal panel 75 as if the symbols were moving behind the opening 72. By controlling the display data transmitter 78 in accordance with the decision of the stop symbol determination circuit 54, the same stop control as in the first embodiment can be performed. It may be possible to use a stationary liquid crystal display panel having a display segment for each winning line in association with a reel having at least one transparent portion.

Figure 8:
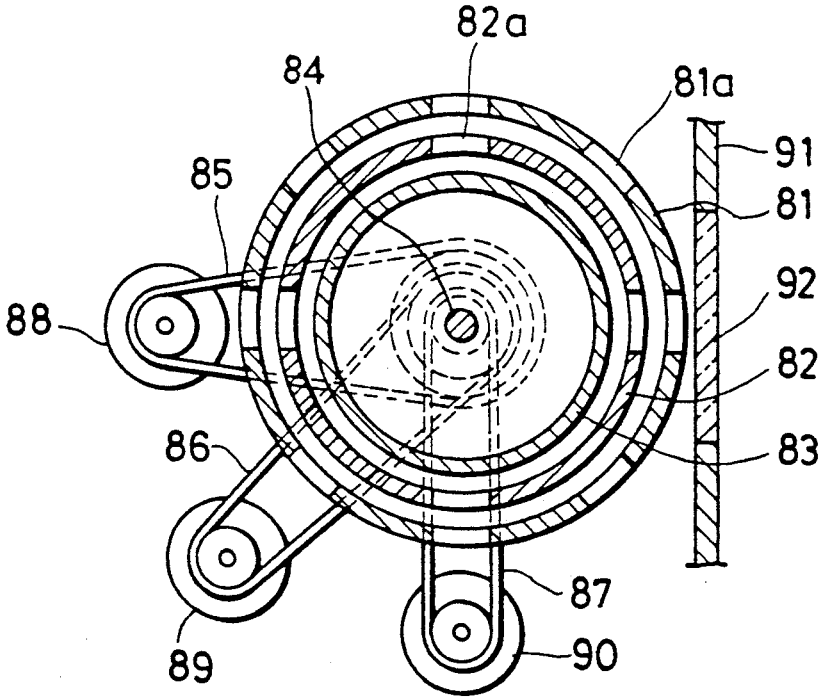
FIG. 8 shows a further embodiment of the present invention.

FIG. 8 shows a triple reel assembly according to a third embodiment of the present invention wherein only the triple reel assembly, with no laterally adjacent reel or reels, is mounted in a slot machine. The first to third reels 81 to 83 of the triple reel assembly are rotatably mounted on a common shaft 84 and are respectively driven by stepping motors 88 to 90 by way of timing belts 85 to 87. The first reel 81 is formed with eight openings 81*a*, and the second reel 82 is formed with four openings 82*a*, while the third reel 83 has no opening but has a plurality of symbols on its outer periphery. The first and the second reels 81 and 82 have no symbols on their peripheral surface areas between the openings. In this embodiment, a front panel 91 is formed with a display window 92.

The first to third reels 81 to 83 are driven to rotate by stepping motors 88 to 90, respectively. Thereafter when all the reels stop, if any symbol on the third reel 83 can be seen through the display window 92 and the openings 81*a* and 82*a*, a prize is awarded for the hit corresponding to the winning rank of the symbol.

It is, of course, possible to provide three winning lines in this embodiment. It is also possible to provide several symbols among the openings 81*a* and 82*a* of the first and the second reels 81 and 82 so that the symbols on the first to the third reels are taken into account for the winning judgment. It may be possible to arrange a number of such triple reel assemblies side by side.

Although the above description substantially relates to the embodiments shown in the drawings, the present invention should not be limited to these embodiments. It is therefore to be understood that within the scope of the appended claims the invention may be practiced or embodied in still other ways. For example, the reels of a multiple reel assembly need not always be rotated coaxially. The drive control of the stepping motors for rotating and stopping the reels is not necessarily performed by means of the circuit shown in FIG. 4, but other various circuits may be used for this purpose. Furthermore, the present invention may be adapted to a game machine in which each rotating reel is mechanically stopped by an arresting hook. For driving the reels of a multiple reel assembly, it may be possible to use a single motor together with a clutch mechanism and selectively to drive the necessary reel or reels through the clutch mechanism. It may further be possible to combine the multiple reel assembly of the invention with a pin ball machine. The additional game button may be omitted, whereby the inner reel is automatically rotated when the opening in the outer reel stops on the winning line.

What is claimed is:

1. Game machine comprising:

display window means;

a first and a second series of symbols, each series comprising a plurality of different symbols;

first display control means for displaying in said window means the first series of symbols in motion and for stopping said first series and for thereafter displaying in said window means a predetermined number of stationary symbols of the first series there being a gap in said first series in which no symbol is present;

second display means for selectively displaying the second series of symbols in motion through said gap only when said gap stops within said window means, and for stopping said second series and for thereafter displaying through said gap only a stationary symbol of the second series.

2. Game machine as defined in claim 1, wherein the first and second series of symbols are displayed on a CRT screen.

3. Game machine as defined in claim 1, further comprising a manually actuated button for selecting the activation of said second display control means when said gap in the first series of symbols stops within said window means.

4. Game machine as defined in claim 1, wherein a plurality of symbol columns are provided, of which at least one symbol column contains the first symbol series, the first and second symbol series overlapping each other.

5. Game machine as defined in claim 4, wherein said second display control means is activated when said gap stops on a winning line of symbols across said symbol columns, the second series of symbols moving while the other symbols remain stationary.

6. Game machine as defined in claim 1, wherein said gap simulates a blank.

7. Game machine as defined in claim 6 wherein said blank is displayed by a liquid crystal display panel driven by a drive unit to display first said blank and then the second series of symbols.

8. Game machine as defined in claim 7, wherein said drive unit is controlled by a display data transmitter for outputting optical signals representative of symbols to be displayed on said display panel.

9. Game machine as defined in claim 8, wherein said optical signals are transmitted through optical fibers.

10. Game machine comprising:

a first rotatable inner reel having a plurality of symbols arranged in a series on its outer periphery;

an outer reel rotating around and arranged C-radially and relative to said inner reel and having a second outer periphery and having both a second plurality of symbols and at least a transparent portion which are arranged in a series on its outer periphery, said transparent portion being at least dimensionally as large as a portion of said outer periphery of said outer reel upon which one of said second plurality of symbols is arranged and being free from any said symbol thereon; and reel control means for selectively and individually controlling the starting and stopping of the rotation of said inner and outer reels each independently of the other and for enabling at least one of said first plurality of symbols to be co-radially aligned with said transparent portion when said inner and outer reels are stationary.

11. Game machine as defined in claim 10, wherein said transparent portion is an opening.

12. Game machine as defined in claim 10, wherein said outer reel is more than one reel disposed coaxially with said inner reel.

13. Game machine as defined in claim 10, wherein each of said inner and outer reels is independently driven by a stepping motor.

14. Game machine as defined in claim 13, wherein said inner and outer reels are rotatably mounted on a shaft, each of said reels being connected with said stepping motor through a transmission means.

15. Game machine as defined in claim 14, wherein said transmission means is a toothed timing belt.

* * * * *